United States Patent [19]

Barnhill

[11] Patent Number: 4,462,625

[45] Date of Patent: Jul. 31, 1984

[54] SAFETY ENTRY LATCHING ARRANGEMENT

[76] Inventor: Alton L. Barnhill, 165 Highland Cir., Paducah, Ky. 42001

[21] Appl. No.: 346,940

[22] Filed: Feb. 8, 1982

[51] Int. Cl.[3] ..... E05C 19/18

[52] U.S. Cl. ..... 292/259 R; 403/109; 403/377

[58] Field of Search ..... 292/63, 67, 259, 341.15, 292/262, 263, 268–270, 277, 289, 292, 295, 337, 338, 339, 2; 403/109, 377; 248/298; 52/111, 632; 70/416–417

[56] References Cited

U.S. PATENT DOCUMENTS

| | | | |
|---|---|---|---|
| 1,282,884 | 10/1918 | Leaver | 292/270 |
| 2,163,206 | 6/1939 | Lopez | 292/259 |
| 2,421,275 | 5/1947 | Lopez | 292/259 |
| 3,608,940 | 9/1971 | Mueller | 292/262 |
| 3,825,290 | 7/1974 | Messina et al. | 292/262 |
| 3,986,741 | 10/1976 | Giovannini | 292/259 R X |
| 4,067,598 | 1/1978 | Mansour | 292/259 R |
| 4,295,676 | 10/1981 | Smith | 292/262 |
| 4,407,418 | 10/1983 | Brammer | 248/298 X |

*Primary Examiner*—Thomas J. Holko
*Assistant Examiner*—Thomas J. Dubnicka
*Attorney, Agent, or Firm*—Warren D. Flackbert

[57] ABSTRACT

A safety entry latching arrangement characterized as a pivotal and extendible securing member attached to an existing door hinge assembly secured onto one side of the framework of an entry and selectively connecting to a latch member disposed on the framework at the opposite side of the entry. The securing member is preferably defined by two parts arranged in a slidable telescopic relationship, where spring urged structure serves to maintain the securing member in an outwardly or upwardly extending latching or storage position, respectively. In a typical arrangement, an audible signaling system can be combined with the handle for the securing member to afford additional protection for the user, i.e. to forewarn unwanted entry.

3 Claims, 6 Drawing Figures

SAFETY ENTRY LATCHING ARRANGEMENT

As is known, the risks of burglary are ever increasing, serving peril particularly to the aged and infirmed. A need has arisen, therefore, for an auxiliary safety mechanism which can provide added security to a conventionally locked door. The latter mechanism should preferably be readily adaptable to a standard door entry and provide for both ready locking and, as well, positionable for ease in entry or exit.

The invention solves such a problem in providing a safety entry latching arrangement which is typically secured to a conventional door hinge assembly mounted on an entry frame, being pivotal to and from both latching and exit/entry positions and susceptible, due to the sliding relationship of the securing member forming the basis thereof, to various entry widths, in addition to compactness when in a non-use or storage position.

The aforesaid securing member is selectively received in a latch disposed on the door frame opposite to the door hinge assembly and provision is afforded, through a spring urged arrangement, for maintaining the securing member in a generally horizontal or locking position. The securing member is readily adapted for use in conjunction with the pin forming part of a conventional door hinge assembly, where slotted cooperative inner slide members disposed within the securing member permit ready extension and at the same time afford a sturdy finished unit. The securing member can be finished to satisfy any decorative needs of the user, as in color, texture or material.

Moreover, the safety entry latching arrangement of the invention is easily installed, being representative of positive and effective auxiliary locking usage, and yet, at the same time, readily positioned to a nonlatching condition as in the instance where rapid exit is required from the safety locked space.

In any event, a better understanding of the present invention will become more apparent from the following description, taken in conjunction with the accompanying drawing, wherein FIG. 1 is a view in front elevation, showing a safety entry latching arrangement in accordance with the teachings of the invention;

Figures 1, 2, 3, 4, 5, 6:
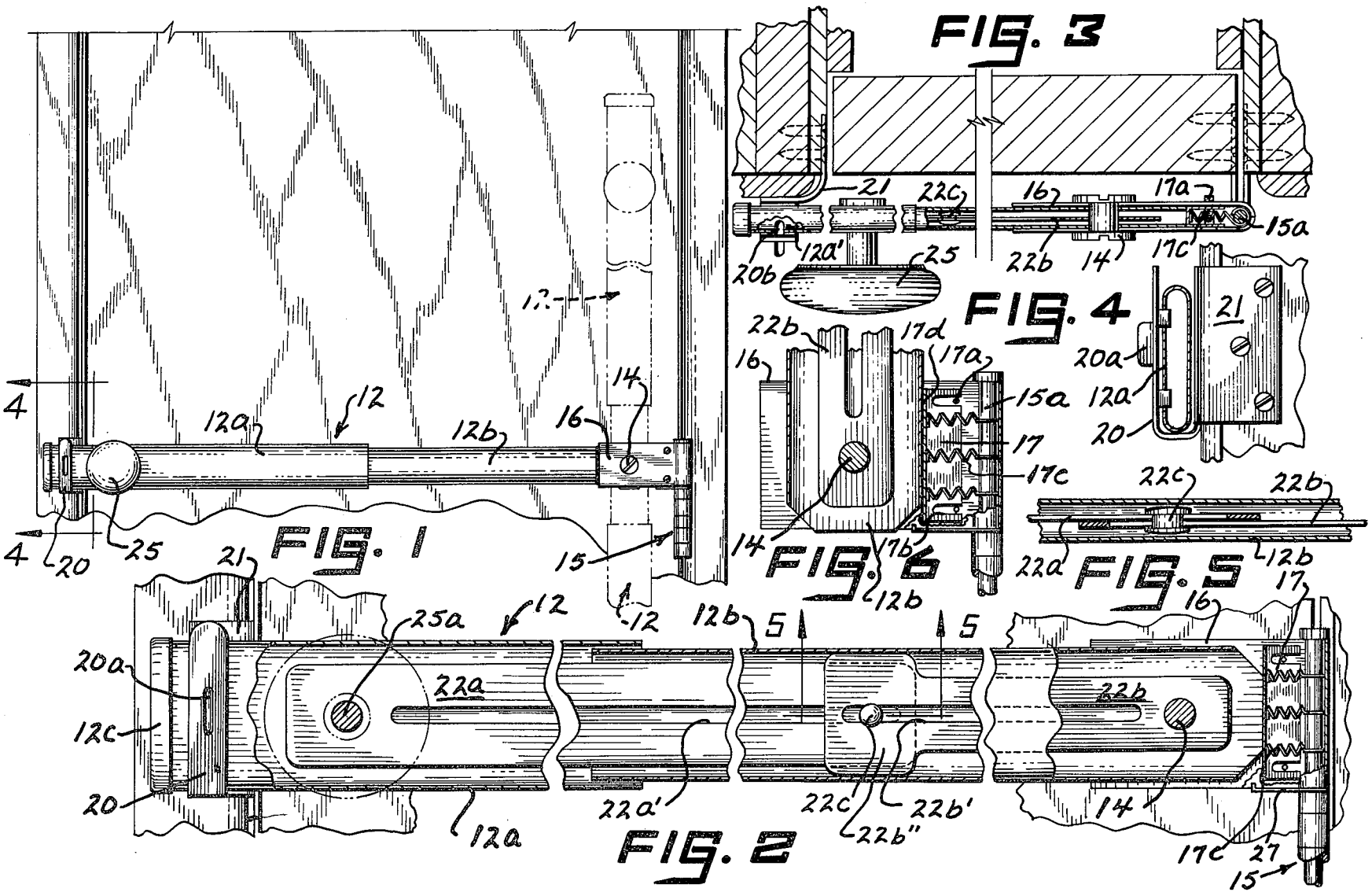
FIG. 2 is an enlarged view in front elevation, comparing to that of FIG. 1, but partly broken away and partly in vertical section, showing certain details thereof.
FIG. 3 is a top plan view of the instant latching arrangement, further detailing the installation thereof in an entryway.
FIG. 4 is a view in vertical section, taken at line 4—4 on FIG. 1 and looking in the direction of the arrows, showing the relationship of the securing member and the latch therefor.
FIG. 5 is a view in horizontal section, taken at line 5—5 on FIG. 2 and looking in the direction of the arrows, showing details of the inner slide assemblies for the securing member; and, FIG. 6 is a view in side elevation, mostly in vertical section, showing the relationship of the securing member when moved to a vertical unblocking position with respect to the entryway.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the securing member 12 of the invention is defined by sections or portions **12*a* and 12*b*, slidable with respect to each other in a telescopic relationship. Portion 12*b* is mounted on a pin 14 which serves as a pivot for the securing member 12, i.e. from the horizontal position shown by the heavy lines in FIG. 1 to the vertical positions shown by the broken lines in FIG. 1**.

The pin 14 extends through a bracket 16 into which portion **12*b* of the securing member 12 extends (see FIG. 3), where the bracket 16 is disposed about hinge pin 15*a* which forms part of a conventional door hinge pin assembly 15 (see FIG. 2**). In other words, a feature of the invention is the ready adaptability thereof to an existing hinge pin assembly commonly found on a door or entryway frame.

As evident in FIGS. 2 and 6, a pressure mechanism 17 is disposed within the bracket 16, movable on pins **17*a* riding in slots 17*b* from the position of FIG. 2 to the position of FIG. 6, and conversely. The pressure mechanism 17 is urged in an outward direction by a series of springs 17*c*, one end of each of which encircles hinge pin 15*a* and where the opposite ends of which bear against the inside of end surface or wall 17*d* of the pressure mechanism 17**.

As will be evident, the pressure mechanism 17 bears against the end, or either the top or the bottom edges of portion **12*b* of the securing member 12, for positive positioning purposes (again see FIGS. 2 and 6**. Thus, locking and/or storage functions are further served.

Portion **12*a* of the securing member 12 has a free end, typically capped at 12*c*, which extends within a U-shaped latch 20, particularly evident in FIG. 4, but also apparent in FIG. 2. The U-shaped latch 20 is secured to a plate 21 mounted onto the inner surface of the doorframe of the entry (see FIG. 3). A pull 20*a* disposed on the front of the latch 20, together with a projection 20*b* on the rear of the front surface of the latch 20, extending into an opening 12*a*' in portion 12*a* of the securing member 12**, combine to serve control/latching purposes.

As to the assembly of portions **12*a* and 12*b* of the securing member 12, and with reference to FIGS. 2, 4 and 5, internal cooperating slidable plates 22*a* and 22*b* are provided, one end of plate 22*a* being secured to the central axis 25*a* of a hand knob 25 for the arrangement, where the far opposite end of plate 22*b* is cooperatively engaged by pin 14. A button type connector 22*c* (see (FIG. 5) extends within and between longitudinal slots 22*a*'–22*b*'** *in the plates 22a* and **22*b* to maintain an assembled and operable relationship. As evident, further stability for usage is provided by the enlarged inner end portion 22*b*'' of plate 22*b***.

In use, and after the securing member 12 has been installed within the door entry, as in FIG. 1, the securing member 12 is extended so that portion **12*a* can be received in the latch 20 and positively anchored therein by projection 20*b*. The arrangement is such that the securing member 12 can be pivoted either upwardly or downwardly to the phantom line positions on FIG. 1 at pivot pin 14. Moreover, the securing member 12 is also movable towards and from the entry, i.e. in a horizontal plane, for reasons of further access, being pivotal on hinge pin 15***a*, where spring 27 serves positioning purposes.

While not described herein, the hand knob 25 may include audible signaling means for advance warning of unwanted entry. A signal of such type could be a spring actuated buzzer, for example, operating similar to an ordinary clock and activated by slight pressure from outside the door. Ordinarily, the alarm will continue to sound until the spring unwinds or is stopped by a person inside of the locked space.

From the preceding, it should be evident that the safety entry latching arrangement of the invention affords a positive locking effect, utilizing a minimum number of components, and requiring no types of fasteners to the door per se. In other words, the invention is not dependent upon the strength of the door for the ability to block unwanted entrance.

The arrangement is susceptible to various changes within the spirit of the invention as, for example, the actual form of telescopic relationship between the portions 12*a* and 12*b* of the securing member 12; overall proportioning; the particular type of latch employed; and, the like. Thus, the preceding description should be considered as illustrative and not as limiting the scope of the following claims:

I claim:

1. A safety entry latching arrangement comprising a frame surrounding an entry, a hinge pin assembly supported on said frame, a pivotal two section securing member having an end hingedly secured to said hinge pin assembly, one section being longitudinally movable with respect to the other, mounting means serving selective pivotal movement of said securing member in an upwardly and downwardly direction, said mounting means hingedly connecting said hinge pin assembly and pivotally receiving one section of said pivotal securing member, means connecting said hinge pin assembly urging said pivotal securing member into a preselected position, a latch disposed on said frame at a side thereof opposite to said hinge pin assembly, said latch including a portion in a selective corresponding latching relationship with the other section of said pivotal securing member, and slidable plates disposed within the two sections of said pivotal securing member, each of said slidable plates including a slotted portion receiving an assembly pin.

2. The safety entry latching arrangement of claim 1 where the end of one of said slidable plates is secured proximate the outer free end of said pivotal securing member and an end of another slidable plate is secured within mounting means for said pivotal securing member.

3. The safety entry latching arrangement of claim 1 where said securing member is also pivotal in a horizontal plane.

* * * * *